US007347033B2

(12) United States Patent
Gamberini et al.

(10) Patent No.: US 7,347,033 B2
(45) Date of Patent: Mar. 25, 2008

(54) METHOD OF PACKING PAIRS OF WRAPPED GROUPS OF CIGARETTES IN HINGED-LID WALLET PACKETS

(75) Inventors: Giordano Gamberini, Bologna (IT); Marco Ghini, Monte San Pietro (IT); Marco Brizzi, Zola Predosa (IT)

(73) Assignee: G.D Societa' per Azioni, Bologna (IT)

( * ) Notice: Subject to any disclaimer, the term of this patent is extended or adjusted under 35 U.S.C. 154(b) by 425 days.

(21) Appl. No.: 11/174,464

(22) Filed: Jul. 6, 2005

(65) Prior Publication Data

US 2006/0005514 A1 Jan. 12, 2006

(30) Foreign Application Priority Data

Jul. 12, 2004 (IT) ..... BO2004A0433

(51) Int. Cl.
*B65B 19/04* (2006.01)
*B65B 19/22* (2006.01)

(52) U.S. Cl. ..... 53/444; 53/462; 53/148; 53/234

(58) Field of Classification Search ..... 53/444
See application file for complete search history.

(56) References Cited

U.S. PATENT DOCUMENTS 1,161,455 A 11/1915 Craggs
1,795,666 A * 3/1931 Molins ..... 53/443
4,034,538 A * 7/1977 Schmermund ..... 53/148
4,308,708 A * 1/1982 Focke ..... 53/136.4
4,559,758 A 12/1985 Gamberini
5,058,363 A * 10/1991 Focke et al. ..... 53/443
5,357,734 A 10/1994 Focke et al.
5,473,862 A * 12/1995 Brizzi et al. ..... 53/447
5,588,281 A * 12/1996 Boriani et al. ..... 53/443
5,647,190 A * 7/1997 Minarelli et al. ..... 53/446
6,941,728 B1 * 9/2005 Bray et al. ..... 53/449

* cited by examiner

*Primary Examiner*—John Sipos
(74) *Attorney, Agent, or Firm*—Birch, Stewart, Kolasch & Birch, LLP

(57) ABSTRACT

A method of packing pairs of wrapped groups of cigarettes in wallet packets with a hinged lid, whereby a blank—having a first portion defining a body, and a second portion defining a hinged lid of a relative wallet packet—is fed into a respective pocket—having a respective pair of adjacent seats—of a packing wheel to define, with the relative first portion, two adjacent receptacles separated from each other by a central rib; the two receptacles are fed through a loading station to successively receive respective wrapped groups of cigarettes having respective collars, and one receptacle is then turned over onto the other to define the body of the relative wallet packet.

16 Claims, 5 Drawing Sheets

METHOD OF PACKING PAIRS OF WRAPPED GROUPS OF CIGARETTES IN HINGED-LID WALLET PACKETS

The present invention relates to a method of packing pairs of wrapped groups of cigarettes in hinged-lid wallet packets, i.e. packets of the type described in WO-8808602 and comprising a cup-shaped body and a lid. The body is in the form of a rectangular parallelepiped bounded by a major front wall and a major rear wall, the lid being hinged to the rear wall; by a bottom wall cut longitudinally into two coplanar halves; and by a first and a second minor lateral wall, of which the first is cut longitudinally into two coplanar halves, and the second is a continuous wall.

BACKGROUND OF THE INVENTION

The body is therefore defined by a first and a second receptacle, which are connected to each other by a longitudinal hinge extending along a central longitudinal portion of the second minor lateral wall, and have respective bottom walls defined by the front wall and rear wall of the body respectively. The receptacles house respective wrapped groups of cigarettes having respective collars, and are movable, when the lid is open, between a closed position, in which the receptacles are superimposed and opposite each other, and the collars are positioned contacting each other, and an open position, in which the second minor lateral wall is folded book-fashion about the longitudinal hinge to define a central longitudinal rib separating the two receptacles, and the collars are coplanar with each other and with the longitudinal hinge, and face outwards.

SUMMARY OF THE INVENTION

It is an object of the present invention to provide a straightforward, low-cost method of producing a wallet packet of cigarettes of the type described above from two wrapped groups of cigarettes having respective collars, and from a flat blank comprising a first portion defining the body, and a second portion defining the lid of the packet.

According to the present invention, there is provided a method of packing pairs of wrapped groups of cigarettes in hinged-lid wallet packets, as claimed in the attached claims.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figures 1, 2, 3:
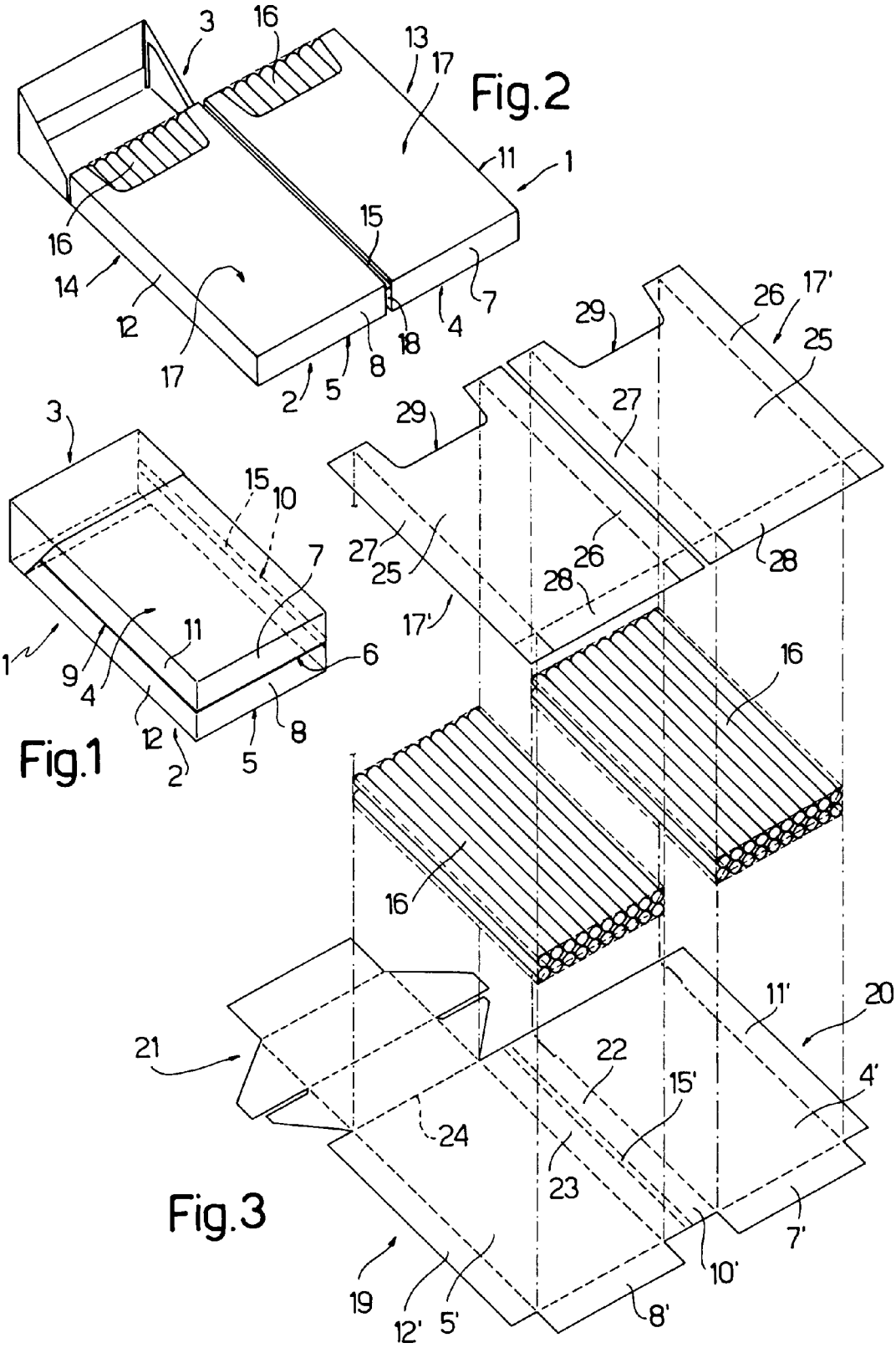
FIGS. 1, 2 and 3 show closed, open, and exploded views in perspective of a first wallet packet respectively.

With reference to FIGS. 1 to 3, number 1 indicates as a whole a wallet packet of cigarettes comprising a cup-shaped body 2 and a lid 3. Body 2 is in the form of a rectangular parallelepiped bounded by a major front wall 4 and a major rear wall 5, lid 3 being hinged to rear wall 5; by a bottom wall 6 cut longitudinally into two coplanar halves 7 and 8; and by a first and a second minor lateral wall 9 and 10, of which lateral wall 9 is cut longitudinally into two equal coplanar halves 11 and 12, and lateral wall 10 is a continuous wall.

Body 2 is defined by a first receptacle 13 and a second receptacle 14, which are connected to each other by a hinge strip 15 extending along a longitudinal axis of lateral wall 10, and have respective bottom walls defined by front wall 4 and rear wall 5 of body 2 respectively. Receptacles 13 and 14 house respective identical wrapped groups 16 of cigarettes having respective identical collars 17 integral with respective receptacles 13 and 14, and are movable, when lid 3 is open, between a closed position, in which receptacles 13 and 14 are superimposed and opposite each other, and collars 17 are positioned contacting each other, and an open position, in which receptacles 13 and 14 are coplanar, lateral wall 10 is folded book-fashion about hinge strip 15 to define a central longitudinal rib 18 separating the two receptacles 13 and 14, and the two collars 17 face outwards.

With reference to FIG. 3, body 2 and lid 3 are formed by folding a flat blank 19, a portion 20 of which defines body 2, and a standard portion 21 of which defines lid 3 and is not described in detail.

Portion 20, the component parts of which are indicated, for the sake of simplicity, using the same reference numbers, with superscripts, as for the corresponding walls of wallet packet 1, comprises two main panels 4' and 5' connected laterally to each other by a central panel 10', along which two central longitudinal fold lines define a central strip 15', and two identical lateral wings 22, 23 located on opposite sides of central strip 15', and of which lateral wing 22 is integral with a lateral edge of main panel 4', and lateral wing 23 is integral with a lateral edge of main panel 5'.

Main panel 4' is also connected to a lateral wing 11' identical to and opposite lateral wing 22, and to an end wing 7' of the same width as lateral wings 11' and 22; and main panel 5' is connected to a lateral wing 12' identical to and opposite lateral wing 23, to an end wing 8' aligned with end wing 7' and of the same width as lateral wings 12' and 23, and to portion 21, which is located at the opposite end of main panel 5' to end wing 8', and is connected to main panel 5' along a hinge line 24.

Each collar 17 is formed from a flat blank 17' (FIG. 3) comprising a substantially rectangular central panel 25, which is substantially the same width as main panels 4' and 5' and has two opposite lateral wings 26 and 27 and an end wing 28. At the opposite end to end wing 28, each central panel 25 has a recess 29.

Figure 4:
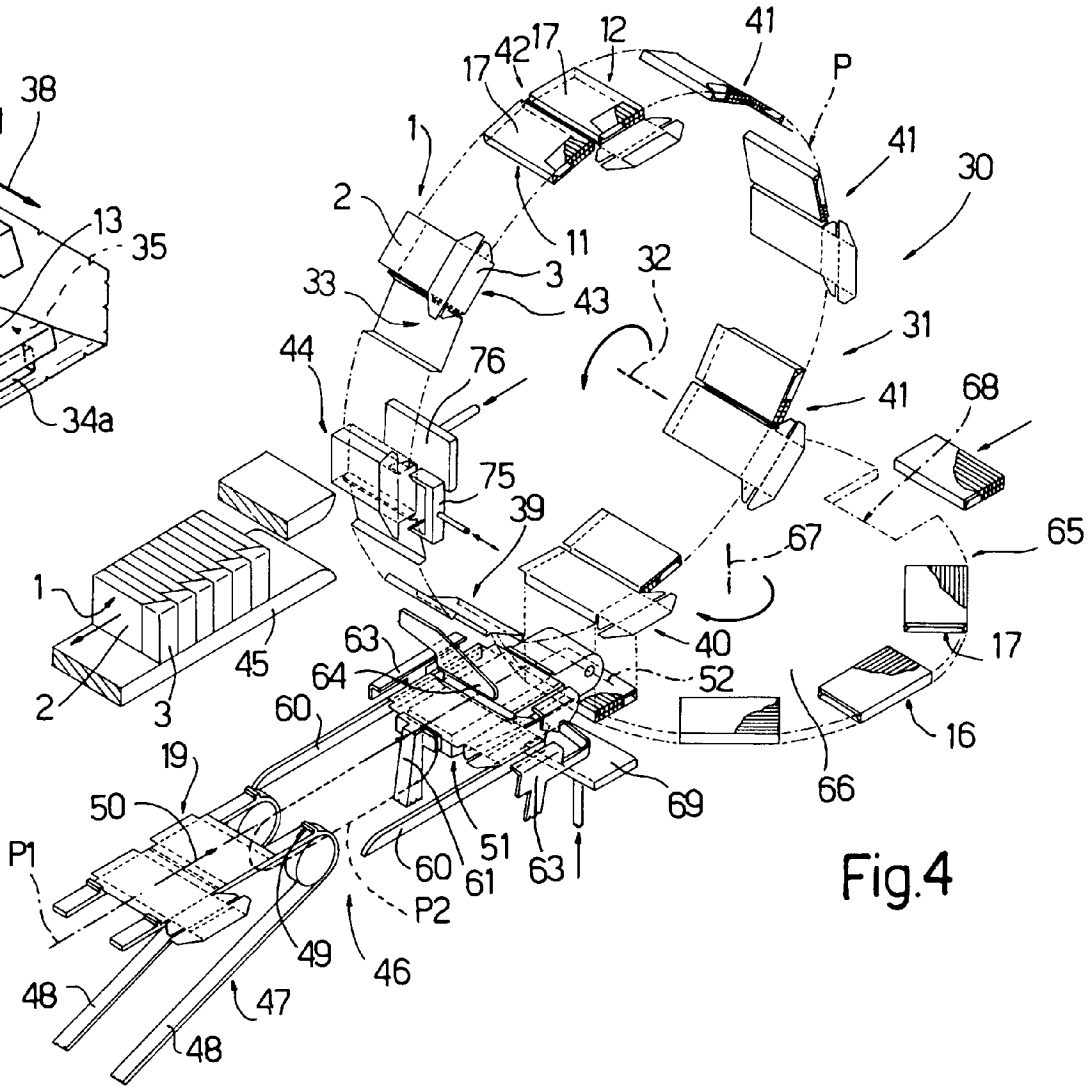
FIG. 4 shows a schematic view in perspective, with parts removed for clarity, of a packing machine for producing the FIG. 1-3 wallet packet using the method according to the present invention.

With reference to FIG. 4, number 30 indicates a packing machine for producing a succession of packets 1.

Figure 8:
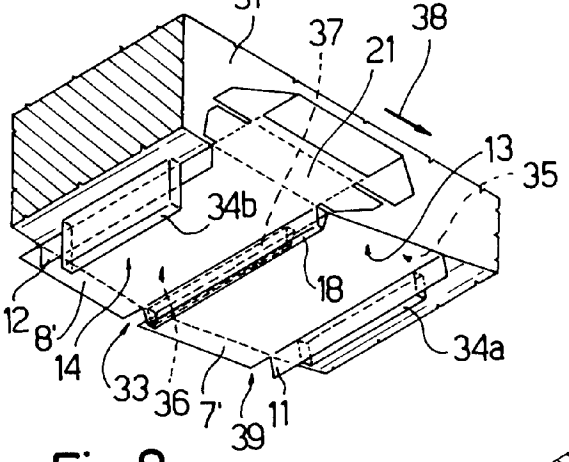
FIG. 8 shows a view in perspective of a detail in FIG. 7.

Machine 30 comprises a packing wheel 31 having a substantially horizontal axis 32 and, along its outer periphery, a succession of pockets 33 equally spaced about axis 32. As shown in FIGS. 5 to 8, each pocket 33 is a suction pocket, is bounded at opposite ends by a front shoulder 34*a* and a rear shoulder 34*b*—both parallel to axis 32, and of which rear shoulder 34*b* is twice the height of front shoulder 34*a*. Pocket 33 is divided into two identical, side by side seats 35 and 36 by an intermediate rib 37 also parallel to axis 32. As shown in FIG. 8, front shoulder 34*a*, rear shoulder 34*b*, and intermediate rib 37 only extend along a central portion of relative pocket 33, so that the longitudinal ends of seats 35 and 36 are free and accessible in a direction crosswise to front shoulder 34*a*, rear shoulder 34*b*, and intermediate rib 37.

Packing wheel 31 is connected to a known motor (not shown) to rotate, anticlockwise in FIG. 4, in steps about axis 32 to feed pockets 33 in a travelling direction 38 along an annular packing path P extending through a loading station 39 for loading flat blanks 19 inside relative pockets 33; a loading station 40 for loading wrapped groups 16 of cigarettes and relative collars 17 inside relative receptacles 13, 14; a succession of folding stations 41 for folding portions 20 of flat blanks 19; a turnover station 42 for turning each receptacle 13 over onto relative receptacle 14; a folding station 43 for folding portions 21 of flat blanks 19; and an unloading station 44 where packets 1 are completed and fed onto an output conveyor 45. More specifically, packing wheel 31 is operated to feed pockets 33 along packing path P in a sequence of alternating first and second steps, of which the first step is a relatively long step equal to the spacing of pockets 33 about axis 32, and the second step is a relatively short step of a length equal to the distance between the axes of seats 35 and 36 of each pocket 33.

Flat blanks 19 are fed to loading station 39 by a feed line 46 comprising an input portion defined by an endless conveyor 47, which comprises two (or more) parallel belts 48 having transverse ribs defining, along a conveying branch of conveyor 47, a succession of pockets 49, each for receiving a relative flat blank 19 and for feeding flat blank 19 in a direction 50 along a substantially horizontal feed path P1 substantially tangent to packing wheel 31 at loading station 40.

Feed line 46 also comprises an output portion defined by a support 51 mounted to oscillate, about an axis 52 parallel to axis 32 and under the control of a known actuating device 53, between a lowered rest position, in which support 51 extends along feed path P1, and a raised work position, in which support 51 is tangent to packing wheel 31 at loading station 39.

Figure 5:
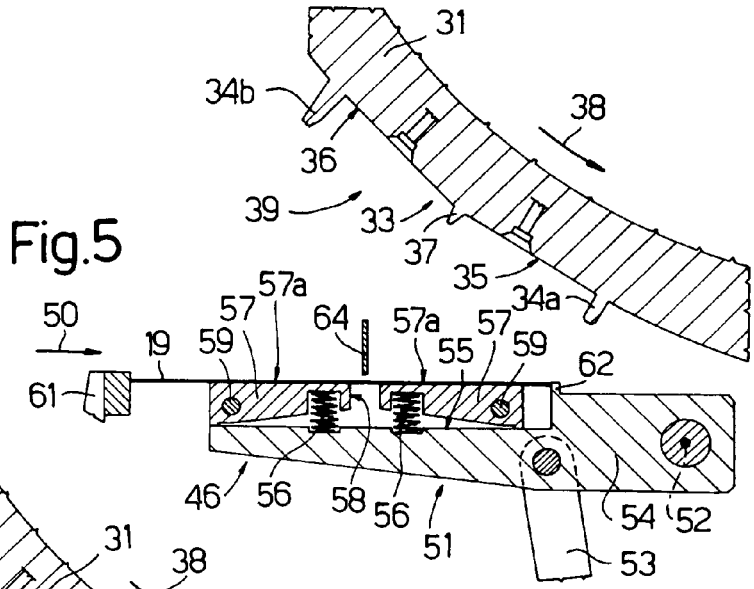
FIGS. 5, 6 and 7 show larger-scale sections of a first detail in FIG. 4 in three different operating positions.
Figure 6:
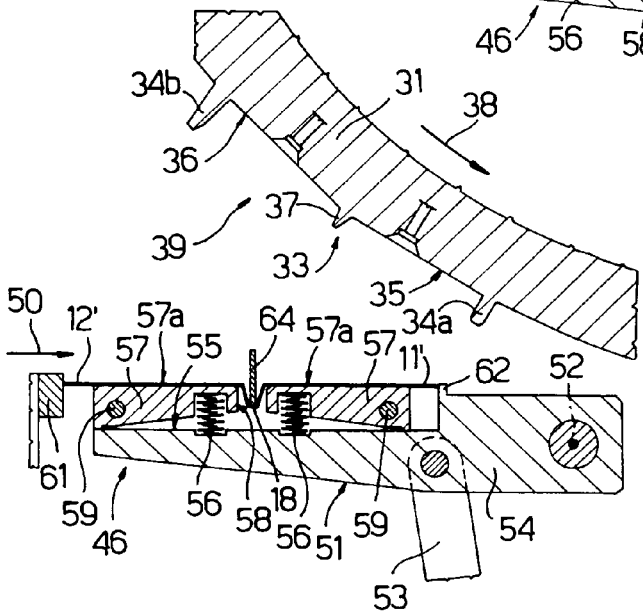
Figure 7:
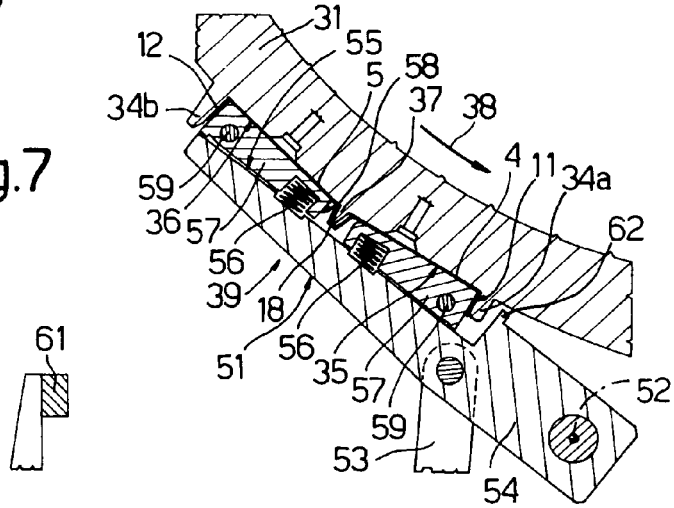

As shown more clearly in FIGS. 5 to 7, support 51 comprises a lever 54, the end of which facing packing wheel 31 is hinged to a fixed pin coaxial with axis 52, and the end of which facing the output of conveyor 47 has a sunken top surface 55, on which two opposed, trapezoidal-shaped levers 57 are fitted, with the interposition of respective springs 56. Levers 57 have respective minor bases facing each other and defining, in between, a gap 58 crosswise to direction 50; and each lever 57 is hinged, close to its major base, on a respective pin 59 integral with lever 54 and parallel to axis 52. Each lever 57 is preferably, though not necessarily, provided with suction (not shown) on its top surface opposite the surface facing sunken surface 55, and is movable, about respective pin 59 and in opposition to respective spring 56, from a raised rest position (FIGS. 5 and 6), in which a top surface 57*a* of lever 57 is coplanar with the conveying branch of conveyor 47 and with the top surface 57*a* of the other lever 57, to a lowered work position (FIG. 7), in which a bottom surface of lever 57 contacts sunken surface 55, and top surface 57*a* forms an upwardly convex dihedron with the top surface 57*a* of the other lever 57.

As shown in FIG. 4, between conveyor 47 and support 51 are located two supporting plates 60 coplanar with the conveying branch of conveyor 47, and a known pusher 61, which is movable, by a known preferably articulated quadrilateral type actuating device (not shown), along an annular path P2, a conveying branch of which extends in direction 50 along feed path P1 and between plates 60, and a return branch of which extends beneath feed path P1 and plates 60.

The conveying branch of path P2 extends between a start position, in which pusher 61 is located between belts 48 and engages the outer edge of lateral wing 12' of a flat blank 19 on conveyor 47, and an end position, in which pusher 61 loads flat blank 19 onto support 51 (in the lowered rest position) with each of main panels 4' and 5' positioned with its inner surface contacting top surface 57*a* of a respective lever 57, with central panel 10' located at gap 58, with an outer edge of lateral wing 11' arrested against a transverse stop 62 integral with lever 54, with lateral wings 11' and 12' projecting in direction 50 from the opposite ends of levers 57, and with portion 21 projecting laterally from support 51.

As shown in FIG. 4, once loaded onto support 51, flat blank 19 is retained releasably, with its inner surface contacting top surfaces 57*a* of levers 57, by a number of L-shaped retaining members 63 parallel to direction 50, located on opposite sides of support 51, and movable, to and from support 51 by oscillating about respective axes (not shown) parallel to direction 50, between a work position substantially contacting support 51, and an outwardly tilted position, in which retaining members 63 allow support 51 to rotate about axis 52 into the raised work position.

With reference to FIGS. 4 to 6, a blade 64 is located over support 51, is crosswise to direction 50, is coplanar with gap 58, when support 51 is in the lowered rest position, and is mounted to oscillate, with respect to support 51 and under the control of a known actuating device not shown, to and from a work position (FIG. 6) in which blade 64 engages gap 58 to engage central strip 15' of flat blank 19 on support 51, and to push strip 15' through gap 58 to define central rib 18.

As shown in FIGS. 6 and 7, once loaded onto support 51, each flat blank 19 is fed into a respective stationary pocket 33 at loading station 39 by rotating support 51 upwards about axis 52 into the raised work position. At the end of this rotation, levers 57 engage respective seats 35 and 36 of the pocket 33, and are moved into the lowered work position by contact with packing wheel 31, so that main panel 4' is brought into contact with the bottom of seat 35, main panel 5' is brought into contact with the bottom of seat 36, intermediate rib 37 (FIG. 8) is inserted inside central rib 18, and lateral wings 11' and 12' are folded squarely onto front shoulder 34*a* and rear shoulder 34*b* respectively, so as to at least partly define the two receptacles 13 and 14.

In the course of the next two steps—a first long step and a second short step—of packing wheel 31, the inner surfaces of lateral wings 11', 12', 22, 23 are gummed, and receptacles 13 and 14 are arrested successively at loading station 40 to receive respective wrapped groups 16 of cigarettes with respective collars 17 from a feed line 65 (FIG. 4).

More specifically, as shown in FIG. 4, feed line 65 comprises an output wheel 66 rotating in steps about an axis 67 perpendicular to axis 32, and comprising a succession of equally spaced peripheral pockets 68, which travel with wheel 66 along a circular path extending beneath packing path P and through loading station 40. Each pocket 68 arrested at loading station 40 houses a respective collar 17, the lateral wings 26, 27 and the end wing 28 of which have been folded squarely to define a hollow seat—positioned with its concavity facing packing wheel 31—for a respective wrapped group 16 of cigarettes resting on the inner surface of central panel 25. At loading station 40, a pusher 69, moving back and forth in a direction parallel to axis 67 and radial with respect to packing wheel 31 and packing path P, expels wrapped groups 16 of cigarettes and relative collars 17 successively from relative pockets 68, and feeds them into respective receptacles 13, 14, so that wrapped groups 16 of cigarettes are positioned directly contacting the inner surfaces of relative main panels 4', 5', and lateral wings 11', 12', 22, 23 are glued to relative lateral wings 26, 27.

As they are fed next through a folding station 41, end wings 7' and 8' are folded squarely in known manner onto respective end wings 28, so that receptacles 13 and 14 of each packet 1 being formed are completed before reaching turn-over station 42.

Figure 9:
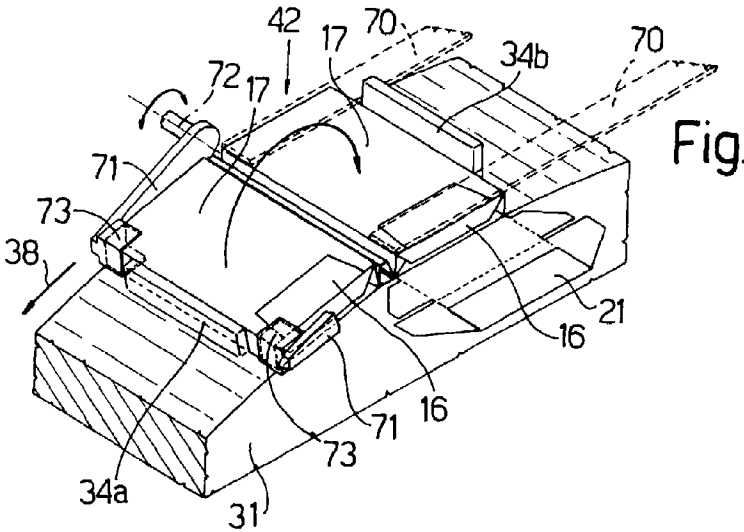
FIGS. 9 and 10 show larger-scale views in perspective of a second detail in FIG. 4 in two different operating positions.
Figure 10:
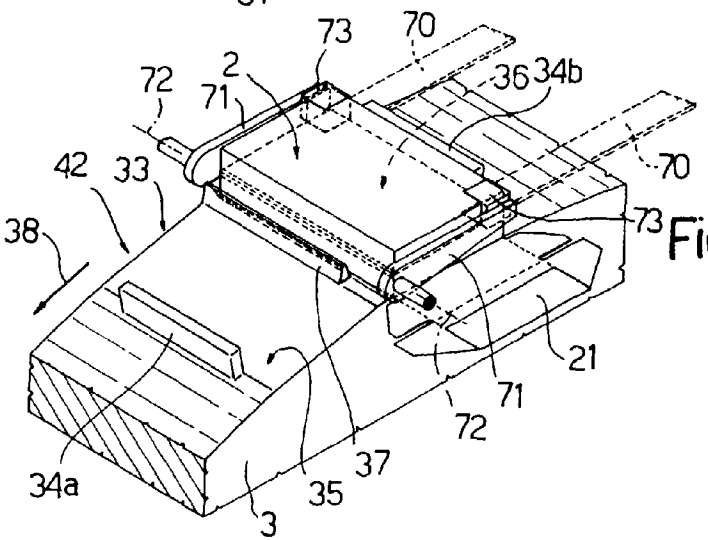

As shown in FIGS. 9 and 10, each packet 1 being completed reaches turn-over station 42 with receptacles 13 and 14 in the open position, and with relative central panels 25 of collars 17 and coplanar with each other, and enters turn-over station 42 first with receptacle 13 at the end of a long step of packing wheel 31, and then with both receptacles 13 and 14 at the end of the next short step of packing wheel 31, to assume the position shown in FIG. 9, in which, receptacle 13 is exposed, while receptacle 14 is located beneath two blades 70, which extend in front of the peripheral portion of packing wheel 31 left clear by shoulders 34*b*, and define the ends of respective cylindrical retaining walls (not shown) surrounding packing wheel 31 between loading station 40 and turn-over station 42 and substantially contacting collars 17 of wrapped groups 16 of cigarettes carried on packing wheel 31.

With reference to the FIG. 9 position, turn-over station 42 comprises two turn-over arms 71 (one of which may be dispensed with) crosswise to axis 32, located on opposite sides of packing wheel 31, and powered in known manner to oscillate about a common axis 72 substantially coaxial with the vertex of intermediate rib 37 of pocket 33 arrested at turn-over station 42. On its free end, each turn-over arm 71 has a parallelepiped-shaped scoop 73, which extends towards packing wheel 31 from relative turn-over arm 71 in a direction parallel to axis 72, is open at the end facing packing wheel 31 and opposite the end connected to relative turn-over arm 71, and is also open laterally on the side facing axis 72. Each turn-over arm 71 rotates approximately 180°, about axis 72 and outwards of the periphery of packing wheel 31, between a first position (FIG. 9), in which turn-over arm 71 is located along packing path P, downstream from axis 72 in travelling direction 38, and alongside seat 35 of pocket 33 arrested at turn-over station 42, and a second position, in which turn-over arm 71 is located along packing path P, upstream from axis 72 in travelling direction 38, alongside seat 36 of said pocket 33, and outwards of blade 70.

Figure 11:
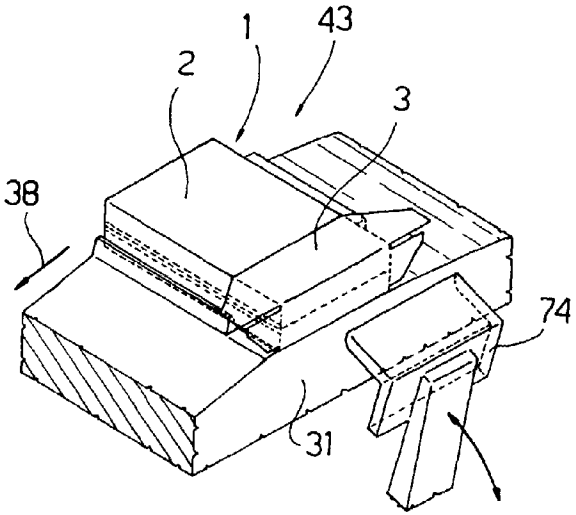
FIG. 11 shows a larger-scale view in perspective of a third detail in FIG. 4.

As shown in FIG. 11, portion 21 of blank 19 of each unfinished packet 1 arrested at folding station 41 is folded in known manner about the open ends of receptacles 13 and 14 by a known oscillating folding device 74 to partly form relative lid 3; and, as shown in FIG. 4, a known axial folding device 75 at unloading station 44 completes lids 3 of packets 1 successively in known manner before a radial pusher 76 successively engages the finished packets 1 to expel them from relative pockets 33 onto output conveyor 45.

Operation of packing machine 30 is self-explanatory from the foregoing description, with no further explanation required, except to point out the following.

Firstly, as regards feed path P1, each blank 19 is fed along feed path P1 with its inner surface facing downwards, i.e. facing feed path P1, up to the output portion of feed path P1 defined by support 51. Consequently, once central rib 18 is formed by blade 64, each blank 19 is fed by support 51 onto packing path P upstream from loading station 40, with its outer surface facing packing path P and packing wheel 31, and therefore in the right position to receive relative wrapped groups 16 of cigarettes and relative collars 17 at loading station 40.

A long step of packing wheel 31 moves front seat 35 of each pocket 33 into loading station 40, and, during the succeeding pause, a wrapped group 16 of cigarettes is loaded into relative front receptacle 13 by the output pusher 69 of feed line 65; and the next short step of packing wheel 31 moves front seat 35 of pocket 33 out of loading station 40, moves relative rear seat 36 into the loading station, and relative wrapped group 16 of cigarettes is loaded into rear receptacle 14.

In connection with the above, it should be pointed out that, by packing wheel 31 performing a succession of alternating long and short steps, both wrapped groups 16 of cigarettes can be loaded into respective receptacles 13 and 14 of each packet 1 being formed using only one loading station 40 and one feed line 65.

As regards turn-over station 42, it should be pointed out that a long step of packing wheel 31 feeds front receptacle 13 of each packet 1 being formed into turn-over station 42. During the succeeding pause, front and rear receptacles 13 and 14 remain beneath blades 70 and undergo no operations. The next short step of packing wheel 31 moves front receptacle 13 out from under blades 70, and the front edges of front receptacle 13 engage scoops 73 of turn-over arms 71 set to the first position along packing path P. During the succeeding pause, turn-over arms 71 are rotated approximately 180° about axis 72 into the second position outwards of blades 70 to turn front receptacle 13 over onto rear receptacle 14, with blades 70 in between. And the next step of packing wheel 31 automatically releases front receptacle 13 (now the outer receptacle) from scoops 73, and automatically releases packet 1 being formed from blades 70.

Figures 12, 13, 14:
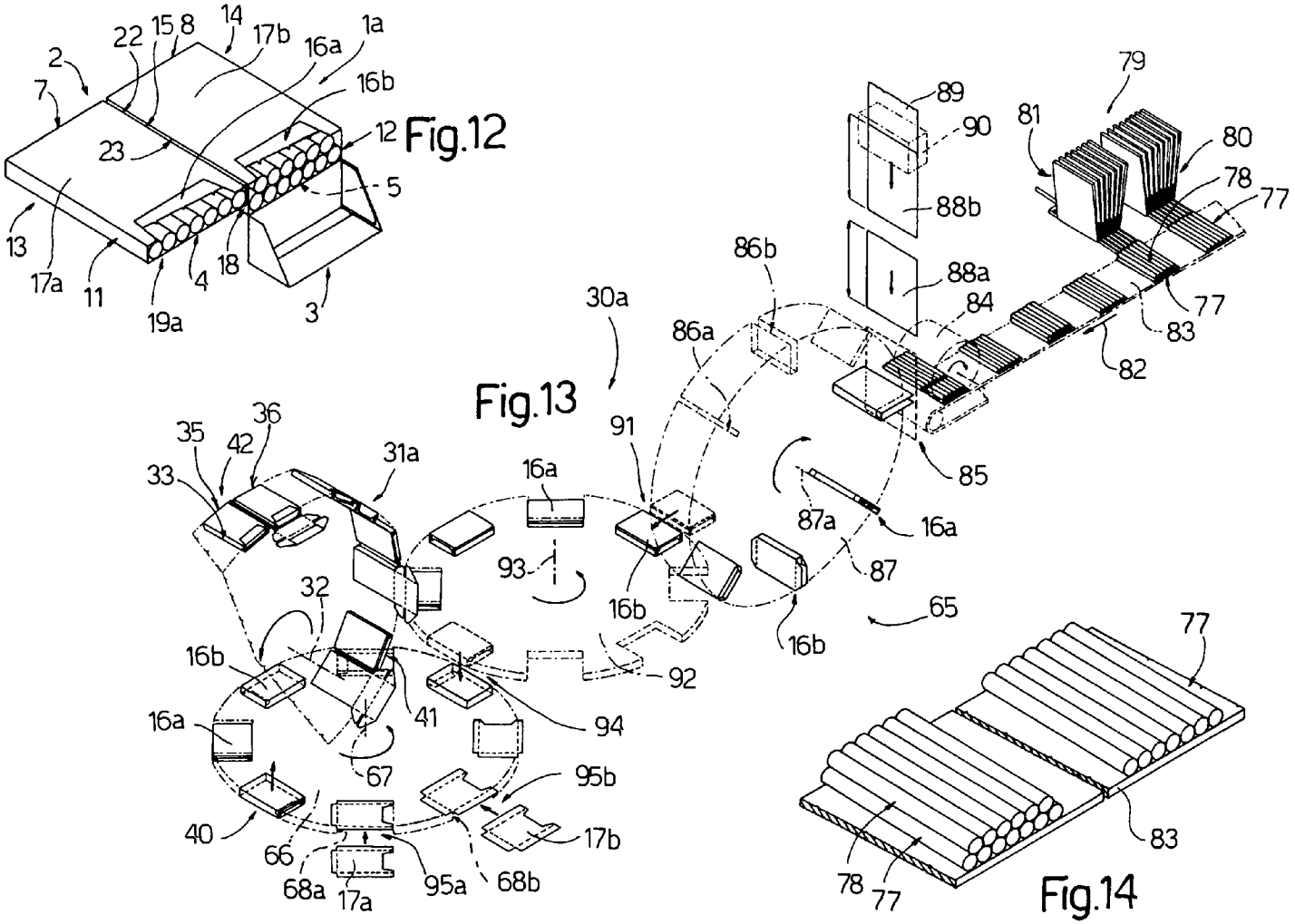
FIG. 12 is similar to FIG. 2, and shows a view in perspective of a second wallet packet in the open position.
FIG. 13 shows a partial, schematic view in perspective, with parts removed for clarity, of a packing machine for producing the FIG. 12 wallet packet using the method according to the present invention.
FIG. 14 shows a larger-scale view of a detail in FIG. 13.

FIG. 12 shows a packet 1*a*, which is similar to packet 1, is formed from a blank 19*a* similar to blank 19, and differs from packet 1 by wrapped groups 16 of cigarettes—hereinafter indicated simply "group 16*a*" and "group 16*b*"—differing from each other, as do respective receptacles 13 and 14. More specifically, group 16*a* is defined, in the example shown, by one layer 77 of seven cigarettes, while group 16*b* is twice the thickness of group 16*a*, and is defined, in the example shown, by two superimposed layers 77 and 78, of which layer 77, like layer 77 of group 16*a*, comprises seven cigarettes, while layer 78 comprises only six cigarettes offset with respect to those in the adjacent layer 77. Similarly, lateral wings 23 and 12' and end wing 8' of blank 19*a* are the same width as one another and are twice the width of relative lateral wings 22 and 11' and end wing 7', so that receptacle 14 is twice the depth of receptacle 13. Collars 17—here indicated 17*a* and 17*b*—preferably also differ, as shown clearly in FIG. 13, so as to adapt to the different thicknesses of relative groups 16*a* and 16*b*. Alternatively, in a variation not shown, both collars 17*a* and 17*b* are identical, and collar 17*b* only partly surrounds relative group 16*b*.

As shown in FIG. 13, packet 1*a* is produced on a packing machine 30*a* similar to packing machine 30, except for a few details, substantially all of which depend on the difference between groups 16*a* and 16*b*.

More specifically, machine 30*a* comprises a packing wheel 31*a*, each pocket 33 of which has a rear seat 36 of twice the depth of relative front seat 35; and, with reference to FIGS. 5 to 7, and as not shown in FIG. 13, the top surface 57*a* of the front lever 57 in direction 50 is raised with respect to the top surface 57*a* of the other lever 57.

As shown in FIG. 13, feed line 65 of packing machine 30*a* comprises an input hopper 79 having at least two outlets 80 and 81 arranged side by side in a direction 82 crosswise to axis 32; outlet 80 has seven side by side downflow channels for forming a succession of layers 77; and outlet 81, located downstream from outlet 80 in direction 82, has six side by side downflow channels for forming a succession of layers 78. Feed line 65 also comprises a conveyor 83, which runs in steps in direction 82 past outlets 80 and 81 towards packing wheel 31*a* to receive successions of layers 77 and 78. More specifically, at each step of conveyor 83, outlet 80 is activated in known manner to deposit a layer 77 onto conveyor 83, while outlet 81 is activated in known manner, every two steps of conveyor 83, to deposit a layer 78 on top an existing layer 77. Layers 77 and 78 are fed from conveyor 83, in known manner by means of a roller 84 and through a transfer station 85, into relative radial pockets 86*a* and 86*b* of a packing wheel 87. At transfer station 85, a succession of alternating foil sheets 88*a* and 88*b* of different lengths, cut from a single continuous strip 89 by a single known cutting assembly 90, are fed between the output of conveyor 83 and packing wheel 87. More specifically, sheets 88*b* are longer than sheets 88*a*, and, as they are fed to a transfer station 91, are folded in known manner about relative pairs of superimposed layers 77 and 78 to form relative groups 16*b*; and, similarly, each sheet 88*a*, as it is fed to transfer station 91, is folded in known manner about a relative layer 77 to form a relative group 16*a*.

At transfer station 91, groups 16*a* and 16*b* are transferred radially into respective pockets of a transfer wheel 92 rotating about an axis 93 parallel to axis 67. At a transfer station 94 diametrically opposite transfer station 91, the outer periphery of transfer wheel 92 is located over the outer periphery of wheel 66 to allow groups 16*a* and 16*b* to be transferred axially to wheel 66 and into respective pockets 68*a* and 68*b*, into which relative collars 17*a* and 17*b* have already been inserted and folded. Collars 17*a* and 17*b* are fed into relative pockets 68*a* and 68*b* at two loading stations 95*a* and 95*b* located along wheel 66, between loading station 40 and transfer station 94. Obviously, only one loading station 95 is required, if collars 17*a* and 17*b* are identical.

The rest of the packing process is the same as described with reference to packing machine 30, and therefore requires no further explanation.

The invention claimed is:

1. A method of packing pairs of groups of cigarettes in respective hinged-lid wallet packets, the method comprising the steps of feeding a blank (19; 19*a*)—having a first portion (20) defining a body (2), and a second portion (21) defining a hinged lid (3) of a relative wallet packet (1; 1*a*)—onto a packing path (P), so as to fold the blank (19; 19*a*) to define a first and a second adjacent receptacle (13, 14) located successively along the packing path (P) and separated by a central rib (18) crosswise to the packing path (P), the second receptacle (14) being connected laterally to said second portion (21); feeding the blank (19; 19*a*) in a given travelling direction (38) along the packing path (P) and through a loading station (40) for loading said groups (16; 16*a*, 16*b*) of cigarettes, by performing two successive stops to arrest said first and said second receptacle (13, 14) successively at the loading station (40); feeding, at each stop, a relative group (16; 16*a*, 16*b*) of cigarettes, having a relative collar (17; 17*a*, 17*b*), into whichever of said first and said second receptacle (13, 14) is currently arrested at the loading station (40); feeding the blank (19; 19*a*) and the relative groups (16; 16*a*, 16*b*) of cigarettes, having relative collars (17; 17*a*, 17*b*), in said given travelling direction (38) along the packing path (P) and through a turn-over station (42); turning said first or said second receptacle (13, 14) over, at said turn-over station (42), onto the other about a vertex portion of said central rib (18), so as to grip the two groups (16; 16*a*, 16*b*) of cigarettes between the superimposed said first and said second receptacle (13, 14); and folding said second portion (21) about the superimposed said first and said second receptacle (13, 14) to form the hinged lid (3).

2. A method as claimed in claim 1, wherein said central rib (18) is formed on said blank (19; 19*a*) along a feed path (P1) of the blank (19; 19*a*); the feed path (P1) being located upstream from the packing path (P).

3. A method as claimed in claim 1, wherein said first and said second receptacle (13, 14) are formed by inserting the first portion (20) of the blank (19; 19*a*) inside a respective conveying pocket (33) travelling along the packing path (P) and having two seats (35, 36) located side by side in said given travelling direction (38).

4. A method as claimed in claim 1, wherein said groups (16; 16*a*, 16*b*) of cigarettes having relative collars (17; 17*a*, 17*b*) are fed successively to the loading station (40) by a single feed line (65).

5. A method as claimed in claim 1, wherein each group (16; 16*a*, 16*b*) of cigarettes having a relative collar (17; 17*a*, 17*b*) is fed into the relative receptacle (13; 14) in a loading direction crosswise to said given travelling direction (38).

6. A method as claimed in claim 2, wherein the packing path (P) is a circular path extending about a first axis (32) crosswise to said given travelling direction (38), and the feed path (P1) is a straight path substantially tangent to the packing path (P).

7. A method as claimed in claim 6, wherein each group (16; 16*a*, 16*b*) of cigarettes having a relative collar (17; 17*a*, 17*b*) is fed into the relative receptacle (13; 14) in a radial loading direction with respect to said packing path (P).

8. A method as claimed in claim 5, wherein the blank (19; 19*a*) is fed along the feed path (P1) with an inner surface of the blank facing the feed path (P1), and up to an output portion of the feed path (P1); the blank (19; 19*a*) being fed onto the packing path (P) upstream from said loading station (40), and with an outer surface of the blank facing the packing path (P), by rotating a support (51) about a second axis (52) parallel to the first axis (32); said support (51) defining said output portion.

9. A method as claimed in claim 8, wherein said central rib (18) is formed when the blank (19; 19*a*) is located at the output portion of the feed path (P1).

10. A method as claimed in claim 1, wherein said step of turning one of the receptacles (13, 14) over onto the other is performed by turning the front receptacle (13), in the given travelling direction (38), over onto the rear receptacle (14), in the given travelling direction (38).

11. A method as claimed in claim 1, wherein said step of turning one of the receptacles (13, 14) over onto the other is performed by feeding said receptacles (13, 14), housing the relative groups (16; 16*a*, 16*b*) of cigarettes having relative collars (17; 17*a*, 17*b*), along the packing path (P) and beneath, and in substantial contact with, at least one blade (70) located at the turn-over station (42) and extending along the packing path (P); arresting the two receptacles (13, 14) at the turn-over station (42) so that the blade (70) only covers the rear receptacle (14) in the given travelling direction (38); engaging a front portion of the front receptacle (13), in the given travelling direction (38), by means of gripping means (71) having at least one recess (73) facing the opposite way to the given travelling direction (38) and which is engaged by said front portion; rotating the gripping means (71) through 180° about a turn-over axis (72) substantially coaxial with the vertex portion of the central rib (18), so as to turn the front receptacle (13) over onto the rear receptacle (14), with the interposition of said blade (70), and so that said recess (73) faces in the given travelling direction (38); and feeding the receptacles (13, 14) in the given travelling direction (38) by withdrawing them from the blade (70) and from the recess (73).

12. A method as claimed in claim 1, wherein said packing path (P) is defined by a packing wheel (31; 31*a*), which rotates in steps about an axis (32) and has a succession of pockets (33) equally spaced with a given spacing, and each having a first and a second seat (35, 36) for receiving respective said receptacles (13, 14) and located side by side along the packing path (P) with a given centre distance shorter than said spacing; the packing wheel (31; 31*a*) being operated to feed said pockets (33) along the packing path (P) in a sequence of alternating first and second feed steps, of which the first feed step is a relatively long feed step equal to said spacing, and the second feed step is a relatively short feed step equal in length to said centre distance.

13. A method as claimed in claim 1, wherein said groups (16) of cigarettes are identical.

14. A method as claimed in claim 1, wherein the groups (16*a*, 16*b*) of cigarettes in each said pair of groups (16) of cigarettes are of different thicknesses.

15. A method as claimed in claim 14, wherein, in each said packet (1*a*), a thicker said group (16*b*) of cigarettes is fed into the second receptacle (14).

16. A method as claimed in claim 15, wherein the thicker said group (16*b*) of cigarettes comprises a superimposed first and second layer (77, 78) of cigarettes; the other group (16*a*) of cigarettes in said pair of groups (16) of cigarettes comprising only said first layer (77) of cigarettes.

* * * * *